United States Patent [19]

Frederick et al.

[11] 4,147,263

[45] Apr. 3, 1979

[54] HIGH LIFT LOADER WITH EXTENDED TRANSFER

[75] Inventors: Sherman B. Frederick, New Hope; Ernst A. Dahlquist, Burnsville, both of Minn.

[73] Assignee: Lull Engineering Company, Inc., St. Paul, Minn.

[21] Appl. No.: 757,397

[22] Filed: Jan. 6, 1977

[51] Int. Cl.[2] ..... B66F 9/00

[52] U.S. Cl. ..... 414/718; 212/55; 414/722; 414/728

[58] Field of Search ..... 214/141, 146.5, 145 R; 212/55, 144; 104/246

[56] References Cited

U.S. PATENT DOCUMENTS

| | | | |
|---|---|---|---|
| 1,319,888 | 10/1919 | Miller | 104/246 |
| 3,170,580 | 2/1965 | Soyko | 214/141 |
| 3,198,359 | 8/1965 | Lull | 214/146.5 |
| 3,423,890 | 1/1969 | Leigh | 214/141 |
| 3,478,894 | 11/1969 | Stauffer | 214/141 |
| 3,572,528 | 3/1971 | Morton et al. | 214/145 R |
| 3,688,930 | 9/1972 | Shumaker | 214/141 |
| 3,836,011 | 9/1974 | Sakamoto et al. | 212/144 |
| 3,967,744 | 7/1976 | Goyarts | 214/146.5 |
| 3,985,248 | 10/1976 | Liegel et al. | 214/141 |

*Primary Examiner*—Francis S. Husar
*Assistant Examiner*—Ross Weaver
*Attorney, Agent, or Firm*—Burd, Braddock & Bartz

[57] ABSTRACT

A versatile mobile high lift loader characterized by an extendible telescopic boom carried by a longitudinally extendible transfer carriage. The transfer carriage travels on stepped fore and aft longitudinal transfer rails for greater operator visibility. The transfer rails are stepped laterally to provide for maximum width of the operator compartment and to permit the use of dual front wheels. The transfer carriage and boom extension travel on cam roller non-friction bearings for cycling demands of the fork lift transferring boom. The transfer rails include readily replaceable hardened wear surfaces on a unitized frame. The loader includes modular drive train fabrication for less expensive manufacturing cost and easier servicing. It is provided with drive line disc brakes and locking differential for easy servicing, non-power assist and positive braking with and without load. The telescoping boom includes a novel hose reel assembly for transfer of internal hosing within the boom. The telescoping boom segments travel on readily replaceable hardened rails that also serve to give outer fiber strength and buckling resistance. The boom may be fitted with a fork lift or crane hook or similar work performing means, dependent upon need. The load handling mechanism can be retracted behind the front wheels for close approach to buildings. Load transfer is by pure horizontal motion.

14 Claims, 19 Drawing Figures

25
20
24
22
23
34
32
35
59
52
18
10
17
14
16

FIG. 6
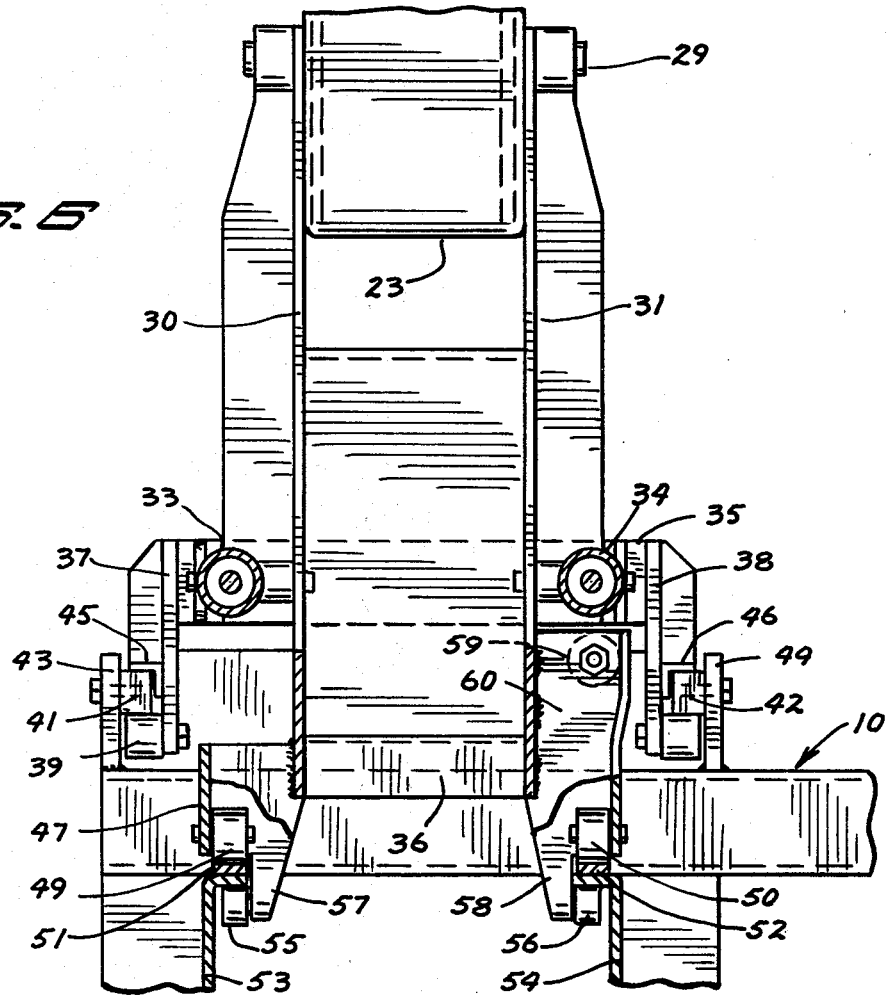
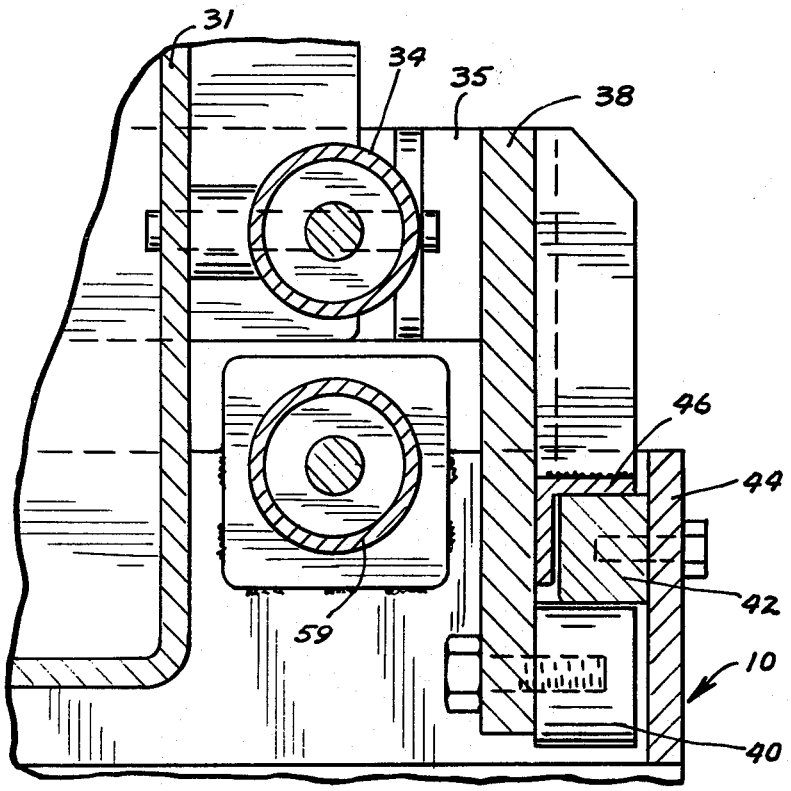
FIG. 7

ZZ
23
24
26
27
84
86
89
90
97
103
105
107
111
113
114
115
116

FIG. 14
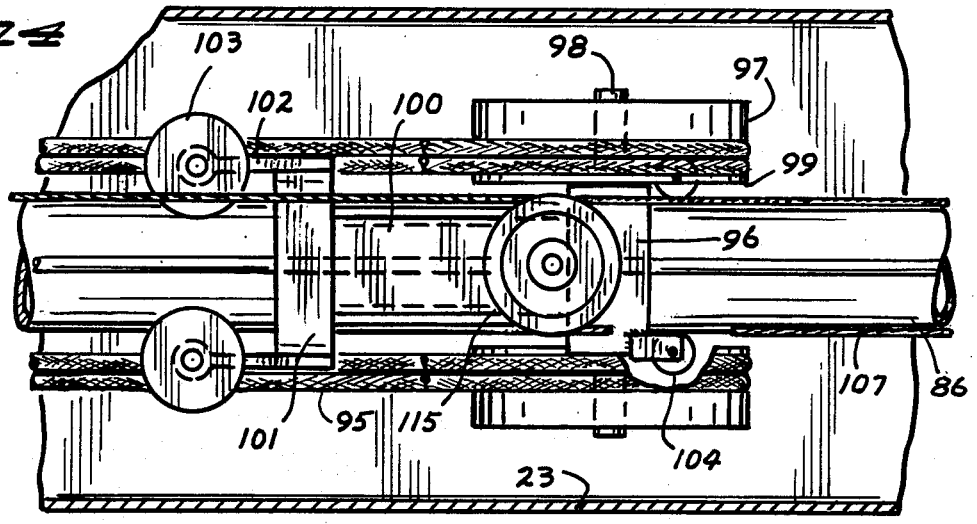
FIG. 13
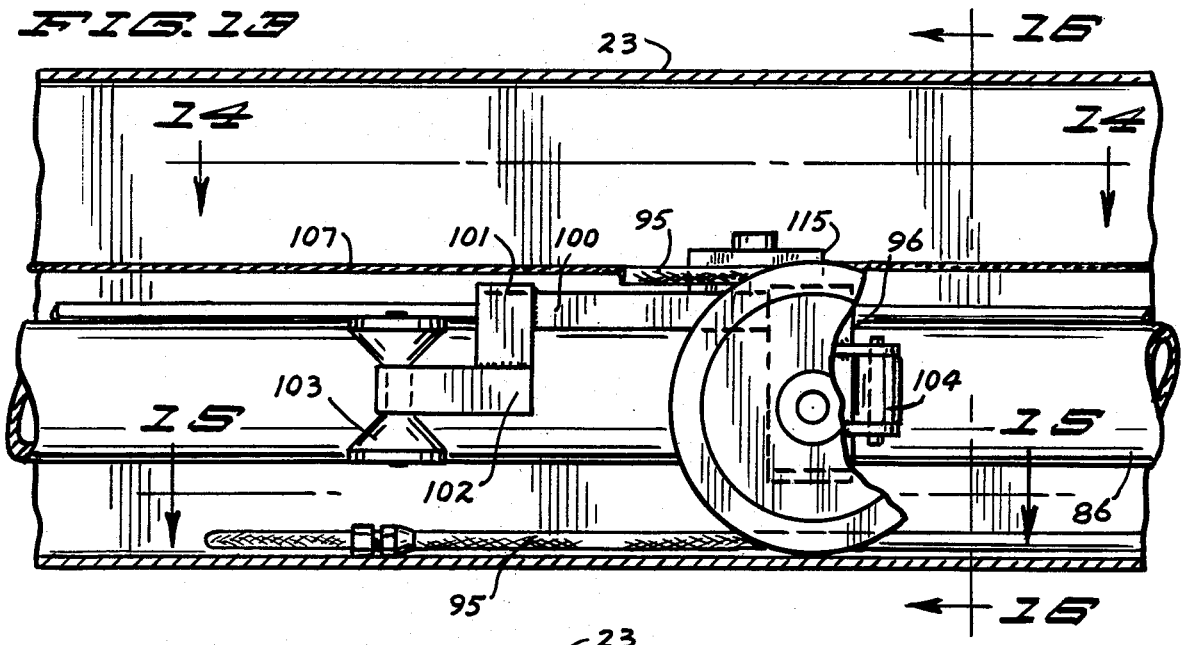
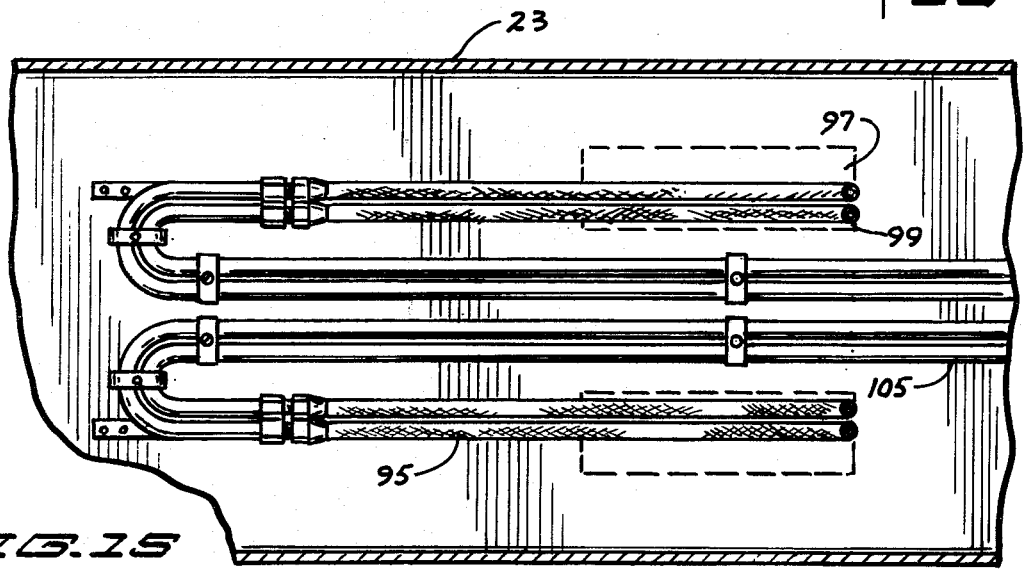
FIG. 15

HIGH LIFT LOADER WITH EXTENDED TRANSFER

BACKGROUND OF THE INVENTION

1. Field of the Invention

This invention is directed to a versatile mobile high lift loader of the type used for material handling jobs that require placing of a load in positions beyond the immediate area of the loader. For example, in construction jobs it is desirable to lift heavy loads such as bricks and other materials and place them on floors within the building under construction which requires movement of the load high above and forward from the loader. For some purposes, it is necessary to reach to a level below that on which the loader rests. A reaching action is often necessary in the unloading of trucks or railroad cars, in the handling of lumber, logs, and the like, etc.

2. The Prior Art

Lull U.S. Pat. No. 3,198,359 discloses one type of reaching loader in which the ends of lift arms can be moved forward of the loader by means of a longitudinally movable carriage to which the lift arms are pivotally secured. This construction separates the reaching action from the raising and lowering action and eliminates many of the disadvantages of earlier loaders. However, the height to which loads may be lifted is limited by the length of the lift arms, and the distance of longitudinal transfer is limited relative to the length of the vehicle.

Goyarts U.S. Pat. No. 3,967,744 discloses a loader in which a load handling device is carried at the end of a boom which in turn is pivotally mounted on a trolley adapted to travel longitudinally along a second boom pivotally secured to the carrier vehicle. This type of loader permits reaching by virtue of the longitudinal travel of the trolley and permits some additional lifting height by virtue of the pivotal movement of the second boom relative to the vehicle. However, here too the lifting height is limited by virtue of the fixed length of the boom supporting the load lifting mechanism.

Lull U.S. Pat. No. 3,178,046 discloses a reaching loader in which the load carrying means is supported at the end of a telescopic boom pivotally secured to a vehicle. Extended reach is accomplished by extension of the telescopic boom but both reach and lifting height are limited by the length of that boom.

SUMMARY OF THE INVENTION

The loader of the present invention includes a motorized four-wheeled vehicle having a unitized longitudinally extending frame. The rearward portion of the frame over the vehicle engine supports a first pair of parallel spaced apart horizontal longitudinal tracks. The forward portion of the frame supports a second pair of parallel spaced apart horizontal longitudinal tracks spaced somewhat lower than the first pair of tracks and preferably spaced inwardly therefrom. A transfer carriage is mounted for longitudinal reciprocal movement on the tracks and is provided with means for reciprocating the carriage between extended and retracted positions. The transfer carriage supports an elongated boom composed of a plurality of telescoping segments. The boom is pivotally secured to the carriage at one end and pivotally supports load handling means such as a fork lift or crane hook or grapple, or the like, at the other end. Means are provided for elevating and lowering the boom relative to the carriage and for extending and retracting the boom segments. The various power means can be actuated selectively to extend and retract the boom, to raise and lower the boom, and to extend and retract the transfer carriage relative to the vehicle. The loader has good stability in various load handling positions. It has the capability of maximum forward extension of the load handling device, combined with maximum vertical lift.

High strength steel is used in the boom structure for minimum lost load and increased capacity. The boom and transfer carriage are provided with hardened shouldered rollers to bear against side members and to take up side thrust. Means are provided to maintain the fork lift level through all operating positions. Extension and retraction transfer of the load is by pure horizontal motion. The vehicle may be provided with dual front wheels for greater stability. Because the load can be retracted behind the front wheels, the vehicle can be moved closer to the building or other work site than has heretofore been possible. In addition to its high lift capabilities, below grade spotting permitting load placement as much as 3½ feet below the grade line is possible.

BRIEF DESCRIPTION OF THE DRAWINGS

The invention is illustrated in the accompanying drawings in which corresponding parts are identified by the same numerals and in which:

FIG. 7 is a fragmentary transverse vertical section on an enlarged scale showing details of the transfer carriage mounting and moving means;

FIG. 8 is a fragmentary transverse horizontal section on the line 8—8 of FIG. 5 and in the direction of the arrows, on an enlarged scale showing details of the drive line disc brake system;

FIG. 10 is a longitudinal section on the line 10—10 of FIG. 9 and in the direction of the arrows;

FIG. 11 is a fragmentary section on an enlarged scale on the line 11—11 of FIG. 12 and in the direction of the arrows;

FIG. 12 is a rear elevational view of the boom;

FIG. 13 is a fragmentary vertical section on the line 13—13 of FIG. 10 and in the direction of the arrows, showing internal boom structure;

FIG. 14 is a horizontal section on the line 14—14 of FIG. 13 and in the direction of the arrows;

FIG. 15 is a horizontal section on the line 15—15 of FIG. 13 and in the direction of the arrows;

FIG. 16 is a transverse vertical section on the line 16—16 of FIG. 13 and in the direction of the arrows;

FIG. 17 is a fragmentary vertical section on the line 17—17 of FIG. 18 and in the direction of the arrows;

DETAILED DESCRIPTION OF THE PREFERRED EMBODIMENT

Figure 1:
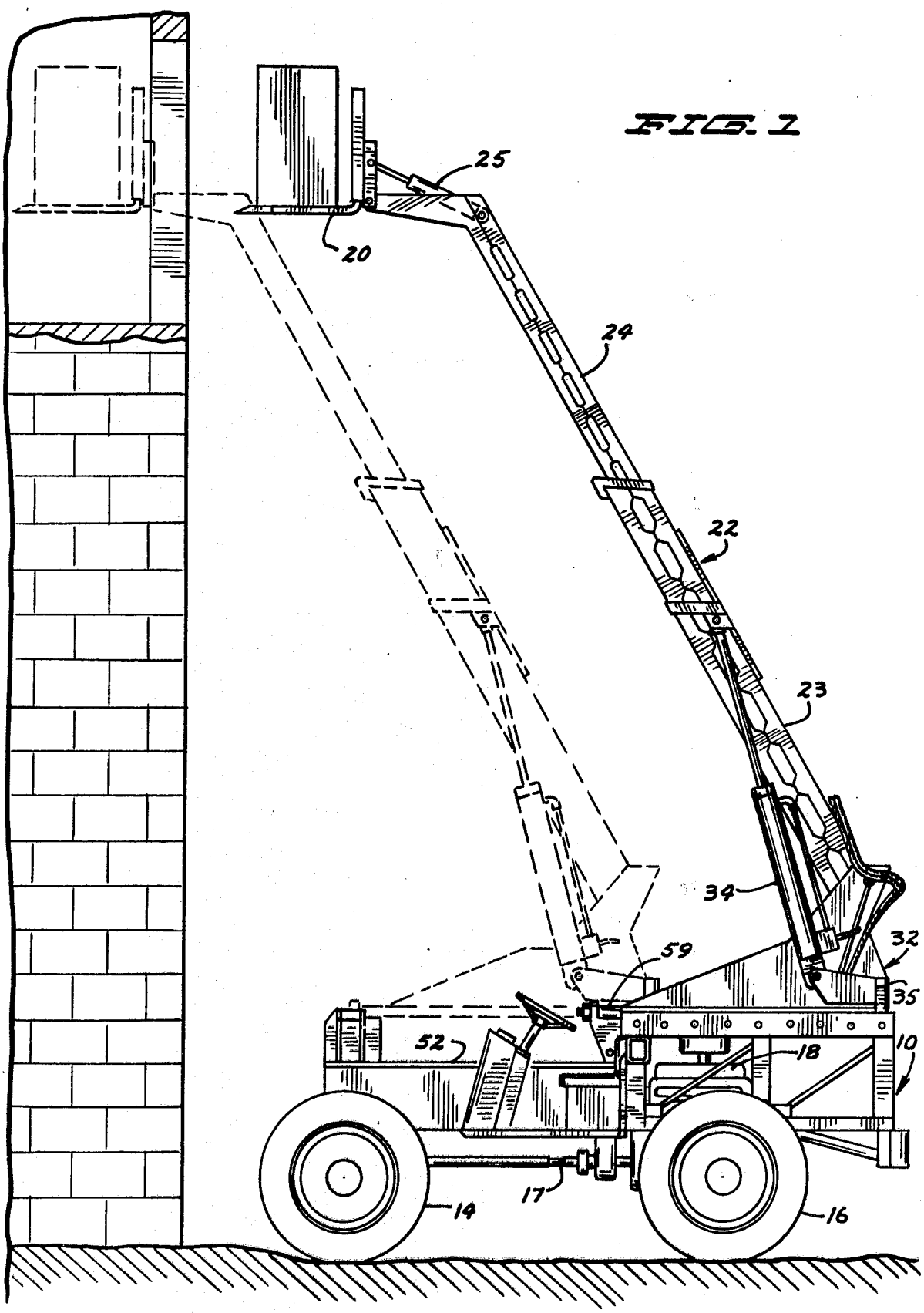
FIG. 1 is a left side elevational view showing the load handling device elevated and showing in broken lines the forward extension thereof.
Figure 2:
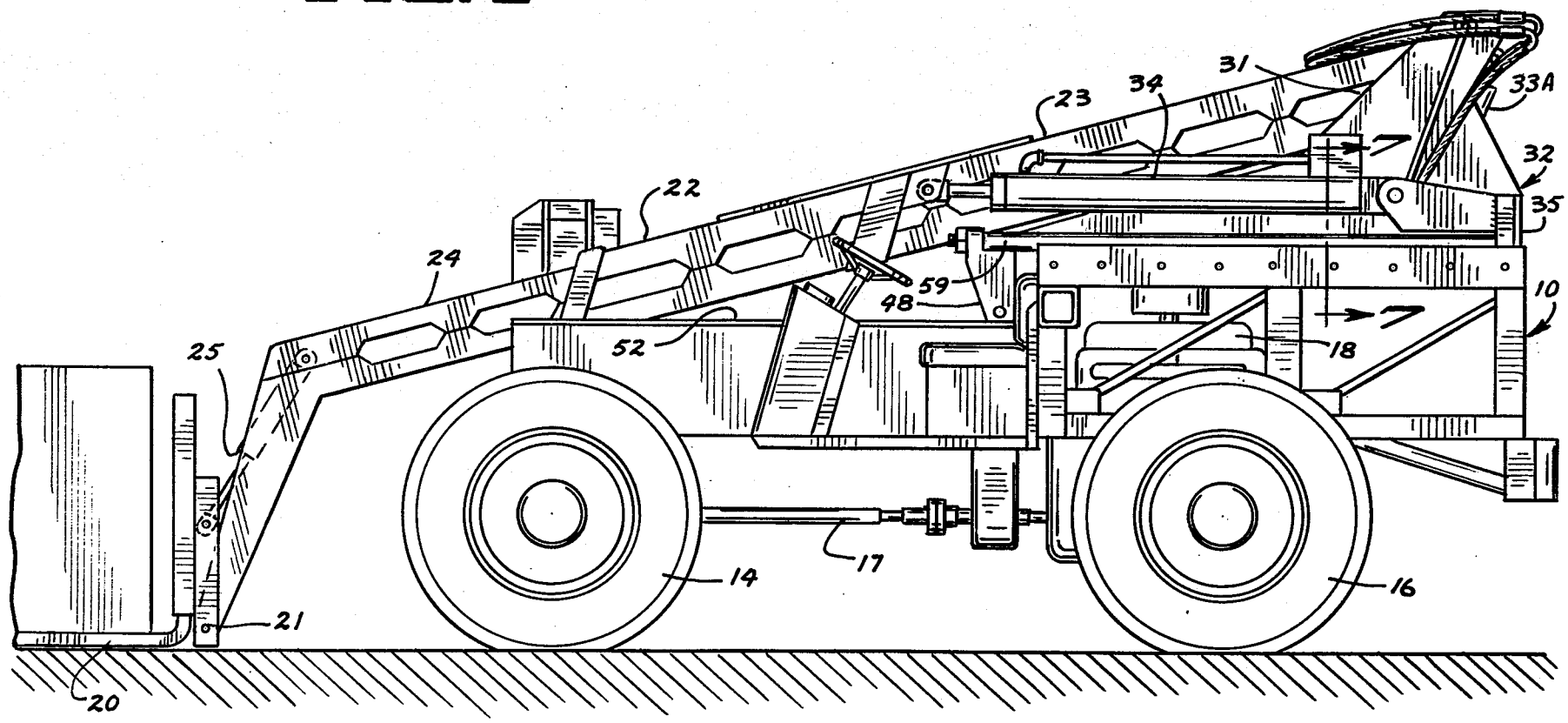
FIG. 2 is a similar right side elevational view showing the load handling device in lowered retracted position.
Figure 4:
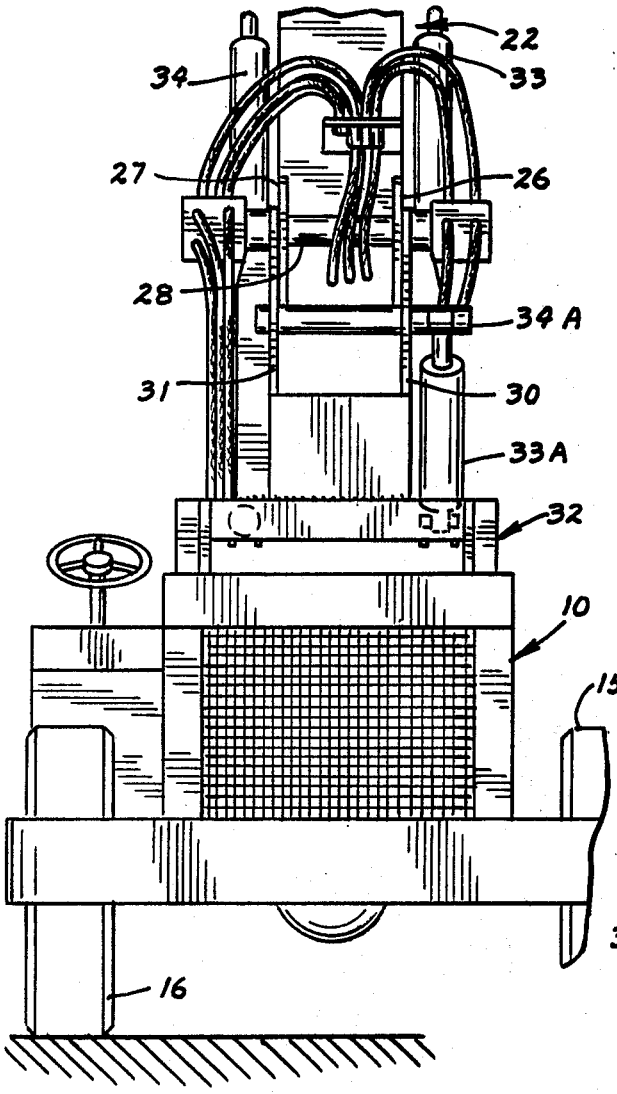
FIG. 4 is a fragmentary rear elevation.

Referring now to the drawings, the loader according to the present invention includes a mobile tractor-like vehicle having a frame, indicated generally at 10, tiltably supported on front and rear axles 11 and 12, respectively, which are equipped with front wheels 13 and 14, and rear wheels 15 and 16, respectively, which are driven through a suitable modular drive train 17 by the engine of the power plant 18 mounted within the frame. The rearward portion of the frame is constructed in the form of a hollow rectangular unitized trussed box within which the engine is mounted for easy installation, servicing and removal.

A load handling device such as a fork lift 20 is pivotally supported at 21 to one end of an elongated boom, indicated generally at 22, and composed of a plurality of telescoping boom segments 23 and 24 of generally rectangular cross section, and preferably provided with spaced apart openings for inspection and service. The fork lift is selectively tiltable by virtue of hydraulic cylinder 25. Fork lift 20 may be replaced by a crane hook or other load handling device, dependent upon the work to be performed by the loader. While boom 22 is shown as composed of two telescoping segments, it may under some circumstances have three or more segments.

Each boom segment is preferably constructed from a pair of U-shaped channel members having spaced apart recesses formed where wall segments are removed from the spaced apart free edges of the channel. The channel members in face-to-face abutment are then welded together along the neutral axis with oppositely spaced apart longitudinal weld lines between the open spaces. This form of construction facilitates assembly, materially reduces the boom weight and provides access ports for assembly, inspection, repair and service of interior boom parts. Hardened ways welded to the boom segments to engage rollers for relative movement of the boom segments increase the boom strength and resistance to buckling.

A pair of parallel spaced apart longitudinal pivot plates 26 and 27 are welded to the top rearmost edges of boom segment 23 and support a bearing sleeve 28 which rotates about a transverse horizontal shaft 29. The ends of shaft 29 are carried in a pair of parallel spaced apart longitudinally extending vertical plates 30 and 31 of a longitudinally reciprocal transfer carriage, indicated generally at 32. Boom 22 is raised by means of a pair of hydraulic cylinders 33 and 34 pivotally connected in suitable brackets to the transfer carriage and to boom segment 23.

Hydraulic cylinder 33A is pivotally connected to the transfer carriage and to shaft 34A at the rear of the boom. Cylinders 25 and 32A are interconnected hydraulically such that as the boom is raised, the piston of cylinder 33A is retracted and the piston of cylinder 25 is extended an equivalent distance. As the boom is lowered, the piston of cylinder 33A is extended and the piston of cylinder 25 is retracted an equivalent distance. In this manner, it is insured that the load on the fork lift remains level as the fork is elevated. At the same time, the fork lift may be tilted independently by exerting hydraulic pressure on cylinder 33A to maintain the piston in equilibrium at any given position and separately applying pressure to cylinder 25. A source of fluid under pressure along with conduits, valves and controls are provided for these and other hydraulic cylinders.

Figure 6:
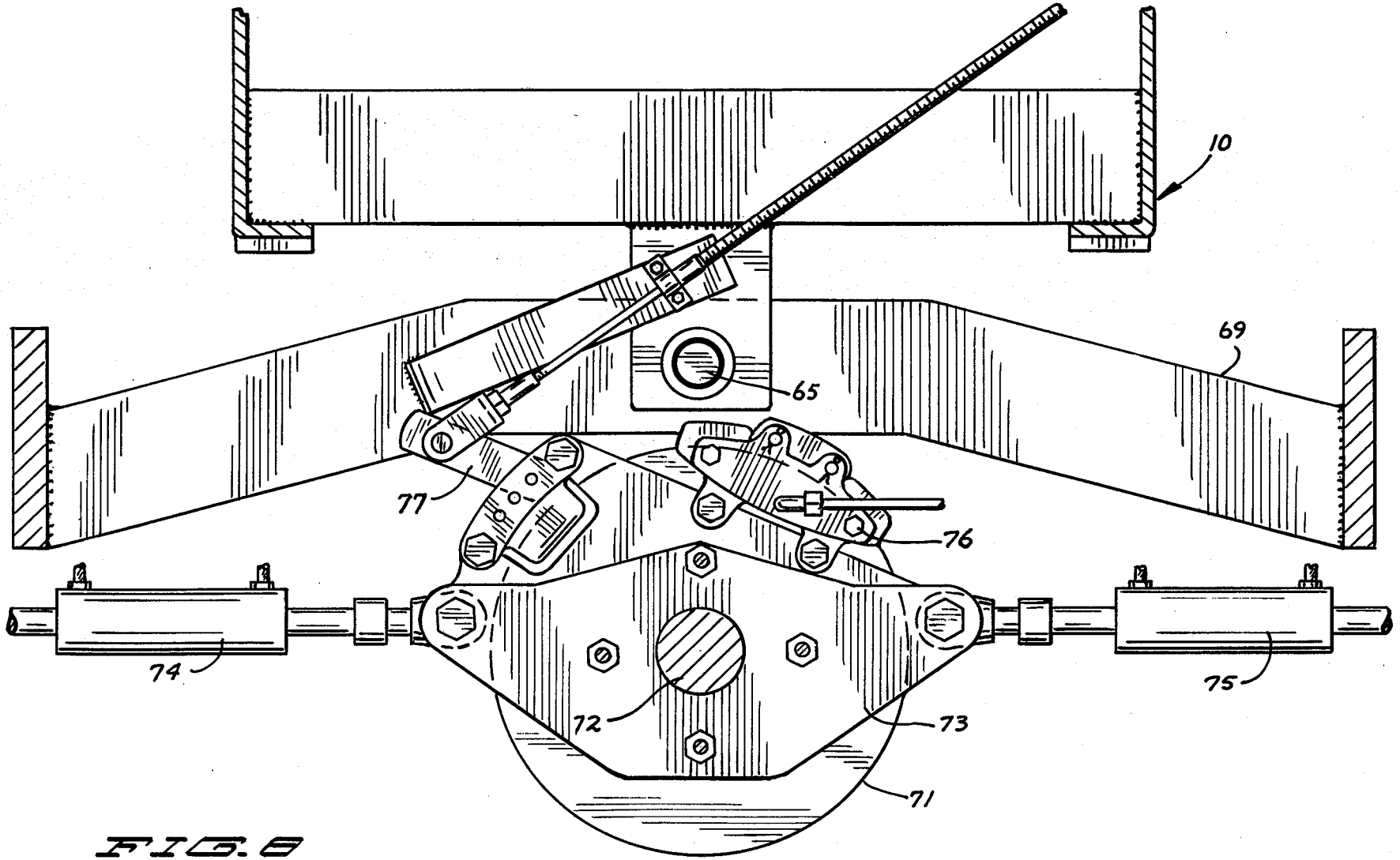
FIG. 6 is a transverse section generally on the line 6—6 of FIG. 5 and in the direction of the arrows but showing cylinders in lowered position.

Transfer carriage 32 includes a rear beam 35 and forward beam 36 welded to the opposite ends of plates 30 and 31. Rear beam 35 extends outwardly from plates 30 and 31 and supports a pair of parallel spaced apart longitudinally extending vertical roller plates 37 and 38, each of which carries a cam roller 39 and 40, respectively. As best seen in FIGS. 6 and 7, rollers 39 and 40 engage the bottom surfaces of hardened rails or tracks 41 and 42, respectively, which are removably secured to parallel spaced apart vertical longitudinally extending plates 43 and 44 which are part of frame 10. The top surfaces of rails 41 and 42 are engaged by wear pads 45 and 46 carried by carriage plates 37 and 38, respectively.

A pair of parallel spaced apart longitudinally extending vertical forward roller plates 47 and 48 are supported from and extend downwardly from the forward end of the transfer carriage. Plates 47 and 48 (FIG. 6) support rollers 49 and 50, respectively, which engage hardened rails or tracks 51 and 52, respectively, which are removably secured to the top surfaces of flanged beams 53 and 54, respectively, forming part of frame 10. Guide rollers 55 and 56 supported by transverse plates 57 and 58 are carried by the forward end of the transfer carriage and engage the undersurfaces of the flanges of beams 53 and 54, respectively.

The transfer carriage 32 is reciprocated longitudinally on tracks 41–42 and 51–52 by hydraulic cylinder 59 fixed at one end to a transverse plate 60 at the forward end of the carriage and fixed at its other end to frame 10. Forward rails or tracks 51 and 52 are spaced downwardly and inwardly from rear rails or tracks 41 and 42. As readily seen by comparison with the loader of Lull U.S. Pat. No. 3,198,359, the stepped track arrangement for the transfer carriage provides improved operator visibility. At the same time, the narrower front frame made possible by the inwardly stepped forward transfer rails permits a wider more comfortable operator compartment and permits the use of dual front wheels without increasing the overall width of the loader. The transfer carriage 32 can be reciprocated the full length of the frame. By providing forward extensions of the pairs of tracks, the transfer carriage can be made to extend over the front end of the frame. For ease of assembly of the loader, the pre-assembled transfer carriage can be positioned by crane or similar means forward of the open front end of the frame and readily eased into operating position engaging tracks 41–42 and 51–52. The operator's compartment is a modular unit. Preferably a single operator's lever or "joy stick" is provided for control of the hydraulic system.

Figure 3:
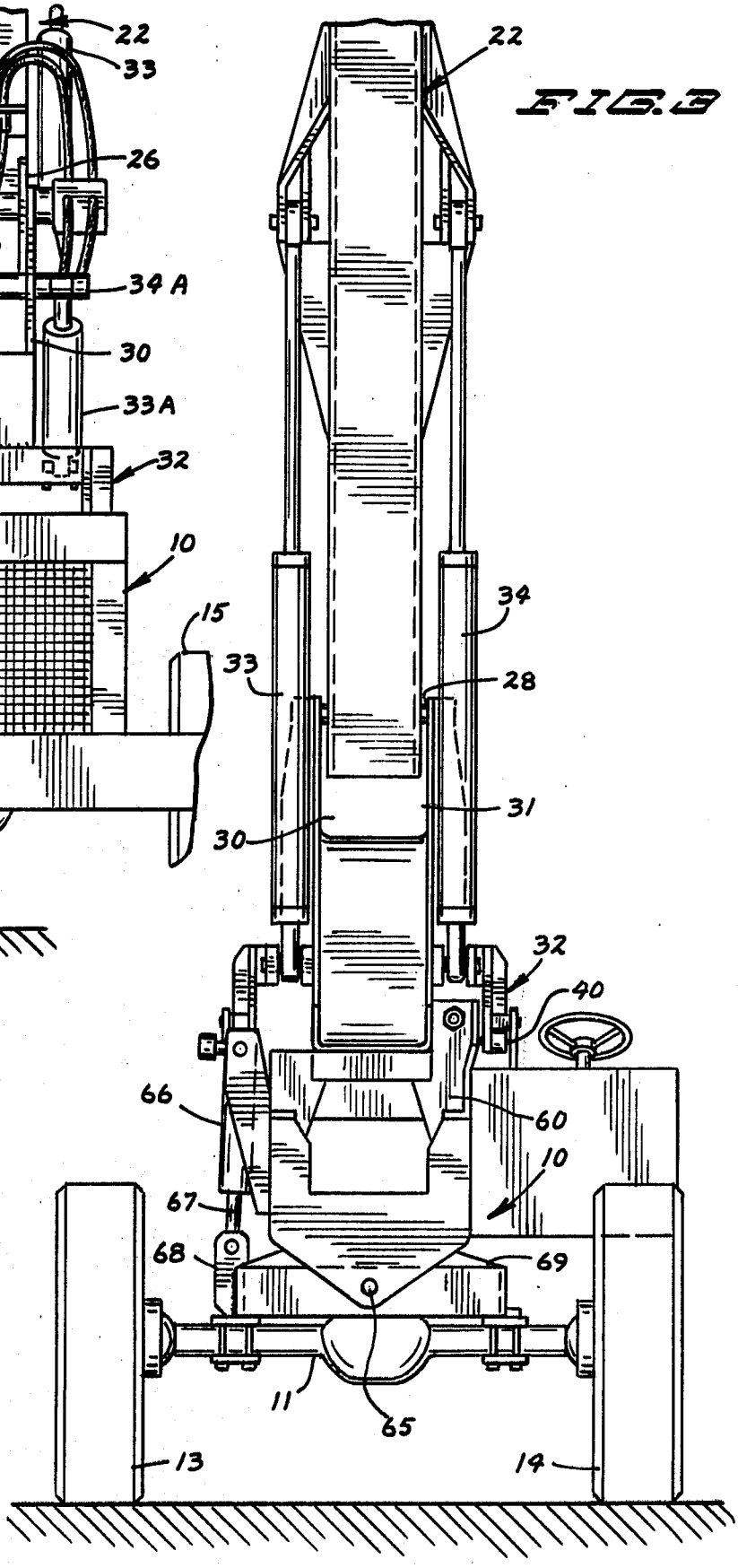
FIG. 3 is a fragmentary front elevation.
Figure 5:
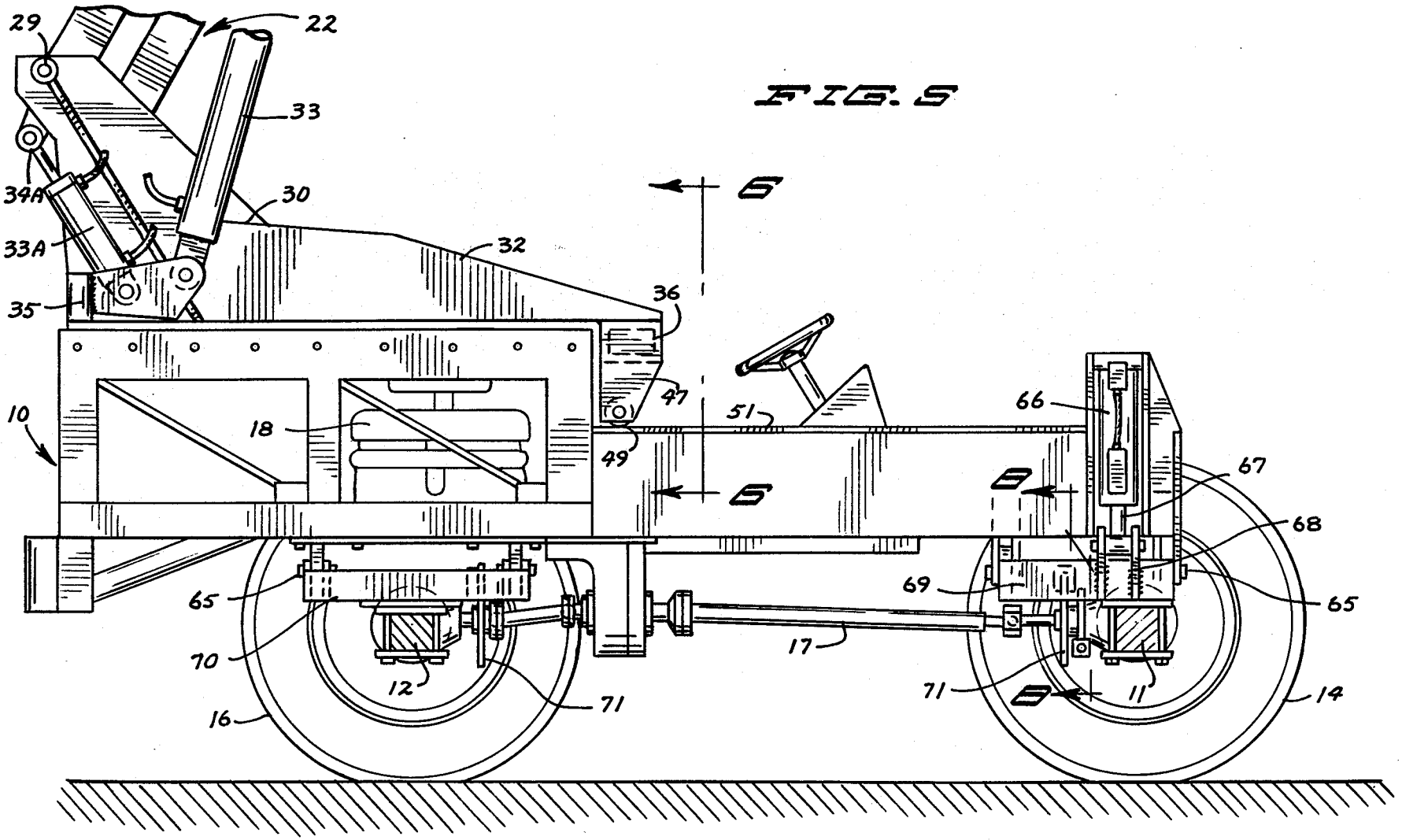
FIG. 5 is a fragmentary right side elevation showing the transfer carriage in retracted position with the boom in elevated position.

When conditions require that the loader be used on a slope or other non-level terrain, the entire frame 10 may be pivoted relative to the wheels and axles on longitudinal axis 65. As best seen in FIGS. 3 and 5, hydraulic cylinder 66 is pivotally secured in a bracket affixed to the front end of frame 10 and piston 67 is pivotally secured to a bracket 68 on a tilt frame 69 supported by axle 11. A similar frame 70 is mounted on rear axle 12.

As best seen in FIG. 8, the loader is provided with drive line disc brakes of the floating friction type described in Hollnagel et al U.S. Pat. No. 3,530,493 incorporated herein by reference. Disc 71 is affixed to drive shaft 72 which extends through plate 73 supported between stabilizers 74 and 75. As described in the aforesaid Hollnagel et al patent, the brake includes a housing 76 having a dead-side member and a live-side member mounted in confronting abutting relation on opposite sides of the rotary disc. The live-side housing member has a load piston mounted therein and a live friction block disposed to be engaged by the load piston. The dead-side housing member has a friction block located stationary within it and the two housing members are rigidly bolted together to provide a central pocket occupied by the friction blocks in spaced parallel relation on opposite sides of the rotary disc.

When the brake is actuated by application of hydraulic pressure on the single load piston, both friction blocks are urged into engagement with opposite sides of the rotating disc. A bias spring mounted outboard of the housings normally reacts between the blocks. The floating mounting of the live-side housing member permits lateral adjustment of the brake to compensate for wear on the friction blocks. A further mechanical actuating means 77, separate and distinct from the hydraulic actuating means, is provided for operating the brake in the event of failure of the hydraulic system. A similar braking system is provided for the back wheels.

The brake disc is mounted on the input of the axle. Reduction through the axle provides an approximate 19 to 1 increase in torque capability. This provides approximately 19 times normal capacity permitting the elimination of need for power assist. Torque is not put directly into the drive shafting.

As best seen in FIGS. 9 and 17–19, inner telescoping boom segment 24 is guided for movement within and forwardly outward from outer boom segment 23 by virtue of a pair of flanged rollers 80 journaled in the underside of the forward end of outer boom segment 23. Rollers 80 engage spaced apart longitudinal wear plates 81 carried on opposite sides of the underside of boom segment 24. The inner boom segment is also guided by a pair of flanged rollers 82 mounted on a shaft 83 carried by the rearmost end of inner boom segment 24 and journaled for rotation in engagement with spaced apart parallel longitudinal wear plates 84 carried on the inside top surface of outer beam segment 23. Rollers 80 and 82 have peripheral flanges which bear against the wear plates 81 and 84, respectively, to take up side thrust. Openings are provided in the side walls of boom segment 23 to facilitate installation and removal of shaft 83. A wear resistant cushion block 85 affixed to the under surface of the rearward end of inner boom segment 24 in sliding engagement with the inner bottom surface of outer boom segment 23 maintains rollers 82 in engagement with wear plate 84 regardless of whatever load may be carried by the boom.

Figure 9:
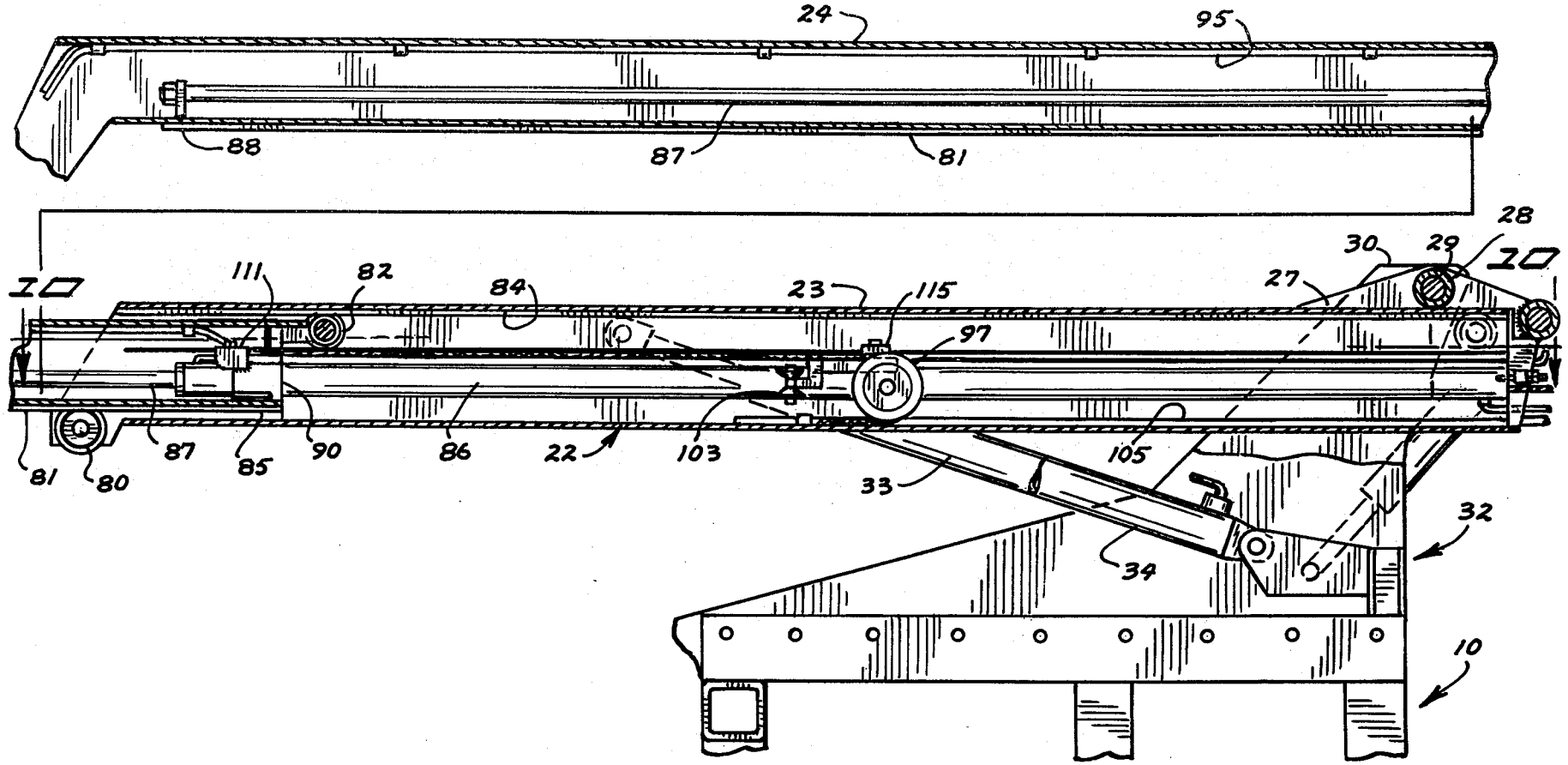
FIG. 9 is a fragmentary left hand side elevation, partly in section, of the boom fully extended and its attachment to the transfer carriage.
Figures 20, 21, 22:
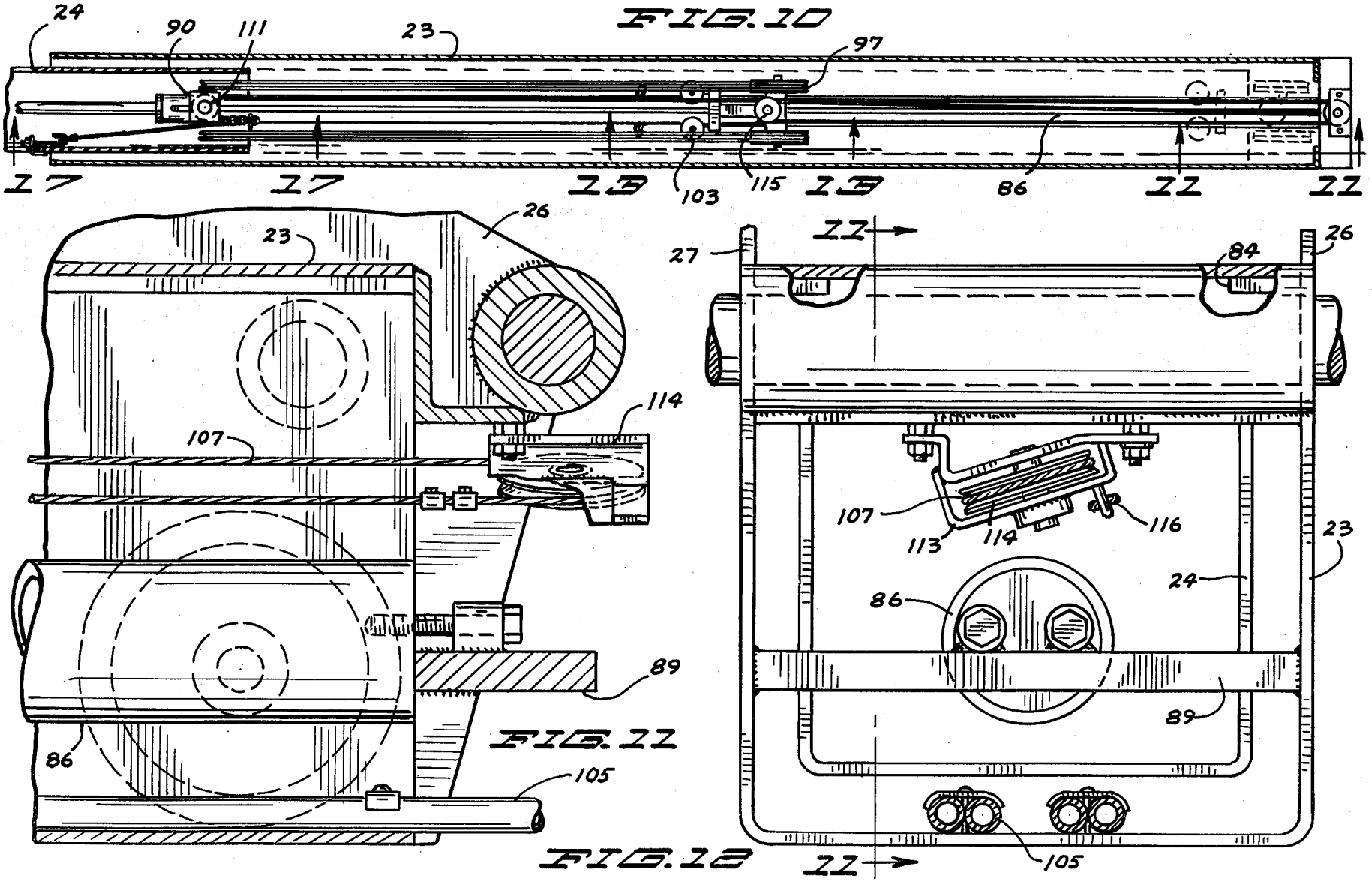
Figure 19:
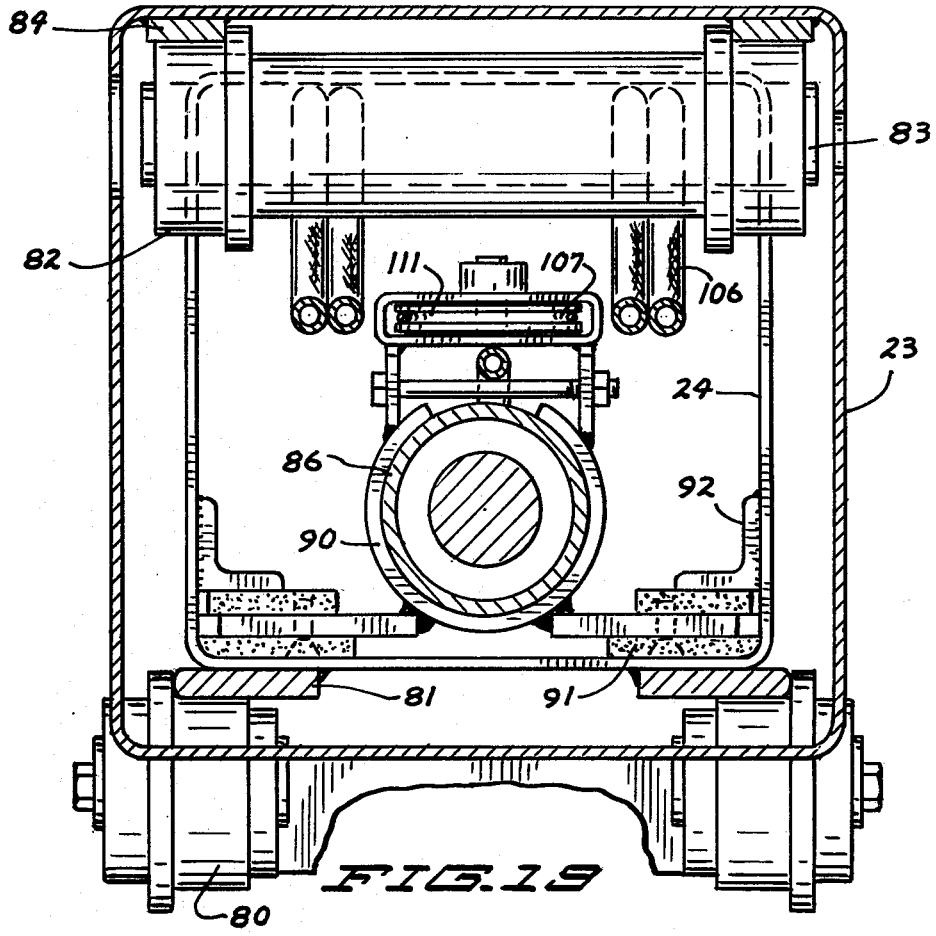
FIG. 19 is a transverse vertical section on the line 19—19 of FIG. 17 and in the direction of the arrows.

Inner boom segment 24 is extended and retracted relative to outer boom segment 23 by virtue of cylinder 86 whose piston rod 87 is fixed to a bracket 88 in the forward end of inner boom segment 24 (FIG. 9). Cylinder 86 is fixed to a cross bar 89 at the rearwardmost end of outer boom segment 23 (FIGS. 11 and 12). To increase the buckling strength of the cylinder, the forward end of cylinder 86 is supported in a cradle 90 having a pair of outwardly extending low friction feet 91 for sliding engagement relative to inner boom segment 24 retained by flanges 92 (FIG. 19).

The hydraulic hosing for manipulation of the load handling means is protected from damage by being enclosed within the boom. In order to avoid tangling of the internal hydraulic fluid hoses 95 for operation of cylinder 25 for tilting movement of fork lift carriage 20, and to avoid damage resulting from tangling, there is provided a hose reel carriage for movement within outer boom segment 23. This carriage moves at one-half the speed and over one-half the distance of the extending or retracting inner boom segment 24. As best seen in FIGS. 13, 14 and 16, the hose reel carriage comprises a frame 96 through which cylinder 86 extends. A pair of wheels 97 are journaled on horizontal shafts 98 extending outwardly on opposite sides of frame 96. Wheels 97 engage the inside bottom surface of outer boom segment 23 for rolling movement therein. A pair of sheaves or pulleys 99 are journaled on shafts 98 between the frame and wheels for rotation with wheels 97. The carriage frame includes a forwardly extending member 100 and cross member 101, the ends of which support a pair of arms 102 each carrying a spool roller 103 for rotation about a vertical axis in engagement with the opposite sides of cylinder 86. A further pair of rollers 104 carried in brackets supported from the rear edge of frame 96 rotate on parallel vertical axes in engagement with cylinder 86. Hydraulic conduits 105, which may be hoses or pipes, are desirably clamped together and are secured to the inside bottom wall of outer boom segment 23 underlying cylinder 86 held by clips or equivalent fastening means. Conduits 105 extend forwardly approximately one-half the length of outer boom segment 23 at which point their direction is reversed and connection made to flexible hoses 95. Hoses 95 then extend rearwardly into engagement with the bottom perimeter of pulleys 99, around the rearward perimeter of the pulleys and thence forwardly from the top of the pulleys into the inner boom segment 24, where the hoses or pipes 95A are attached to the inside top surface. Fixed connections 106 at the rearward end of inner boom segment 24 facilitates joining of hose segments 95 within the outer boom segment to hoses or pipes 95A within the inner boom segment. It will be seen that as the boom is extended and inner boom segment 24 is extended forwardly, the hose reel carriage moves forwardly at one-half the speed and over one-half the distance feeding the appropriate amount of hose to boom segment 24 corresponding to the shortening of the hose between the carriage and connections with conduits 105.

Figure 18:
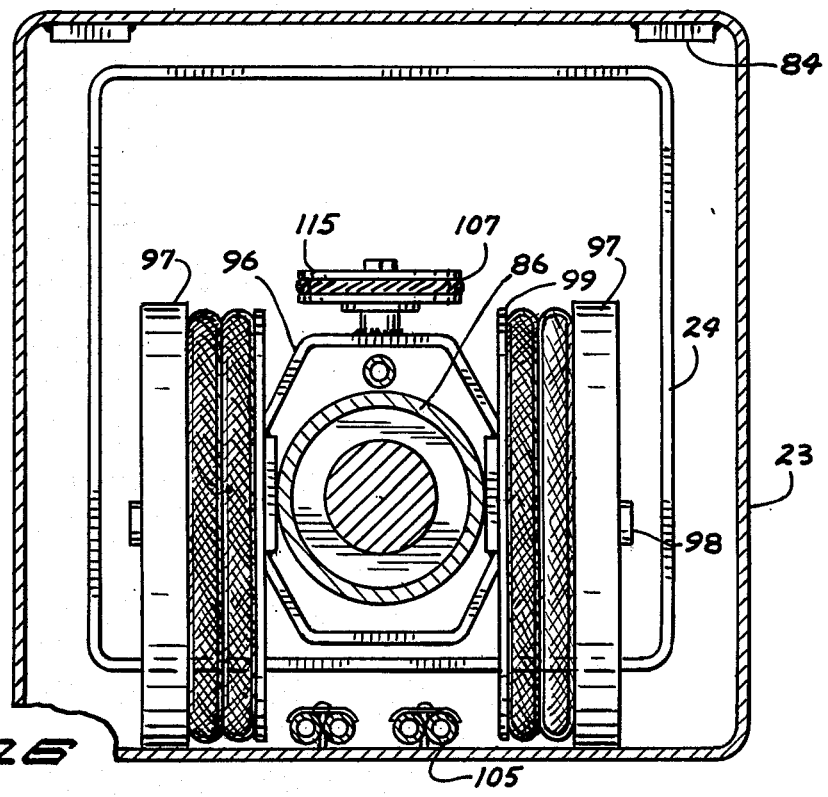
FIG. 18 is a fragmentary horizontal section on the line 18—18 of FIG. 17 and in the direction of the arrows.
Figure 28:
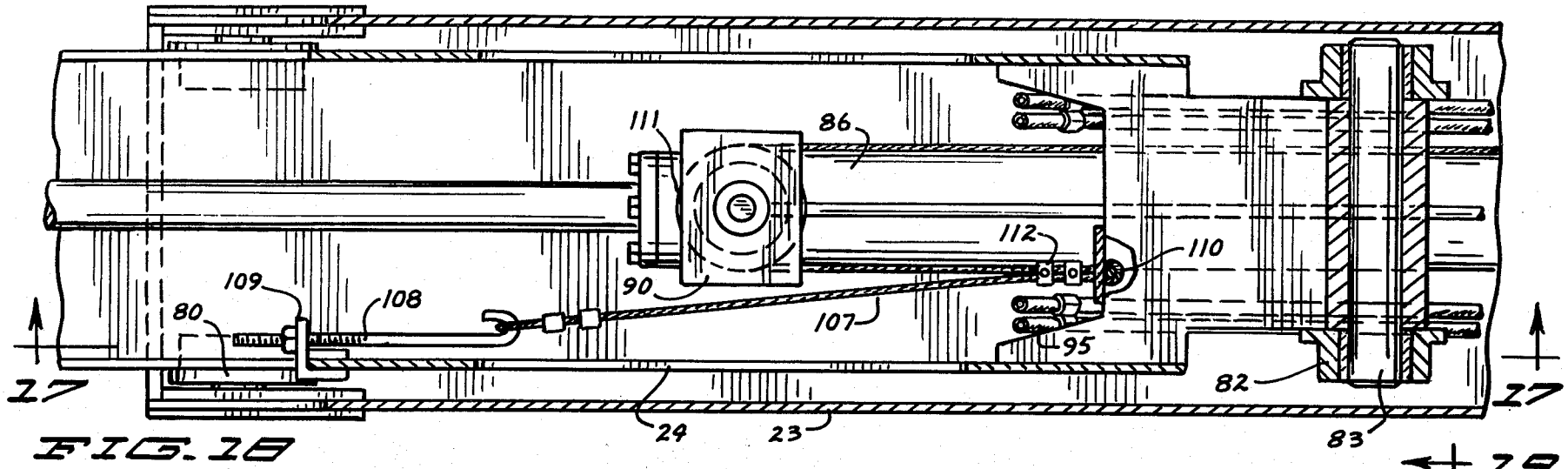
Figure 27:
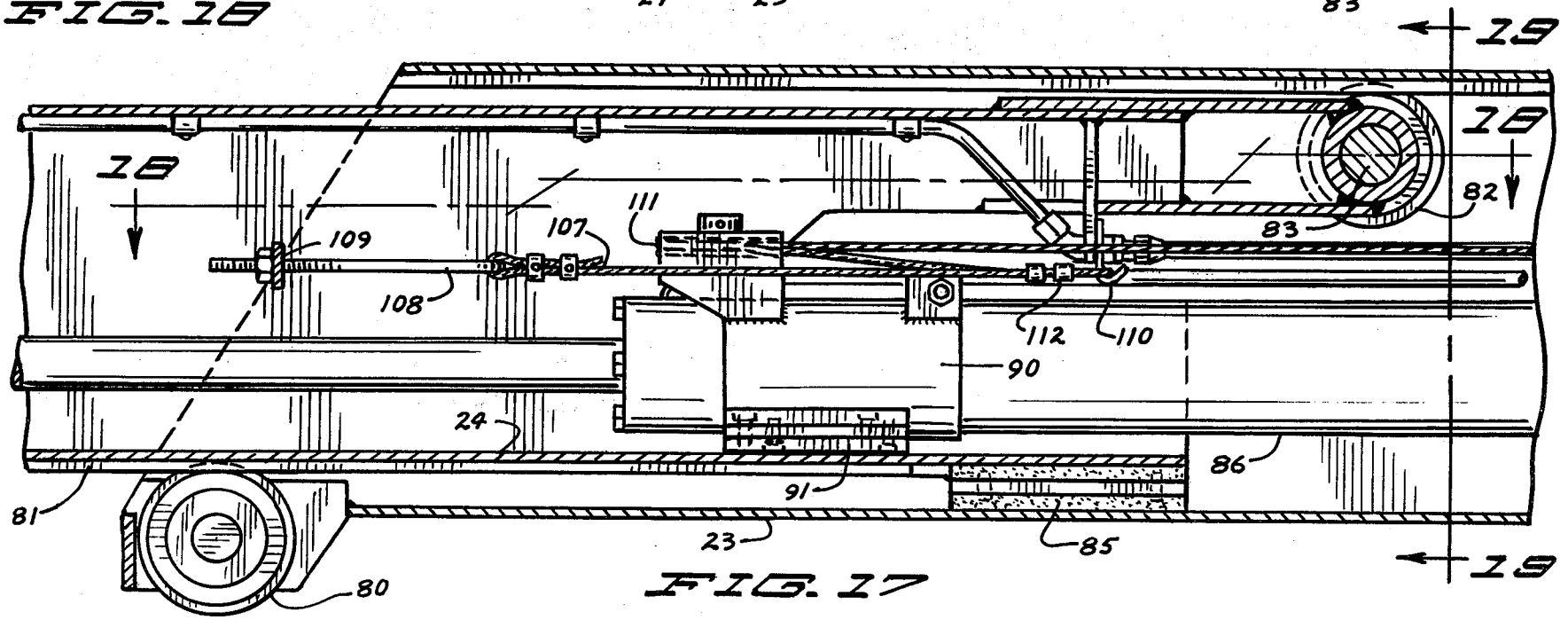

In order to maintain proper tension upon the boom hoses and to guide the movement of the hose reel carriage during retraction of the boom, an adjustable cable system is provided. The forward or downstream end of cable 107 (or equivalent linear motion transmission element) is anchored in the rearward end of inner boom segment 24 by virtue of an adjustable fastening means such as threaded J-hook 108 engaging a bracket 109 in the side wall of boom segment 24 (FIGS. 17 and 18). Cable 107 extends rearwardly around a stationary hook member 110 and then forwardly around pulley 111 (FIGS. 17–19) supported for rotation about a vertical axis on the top of cradle 90 which is stationary at the forward end of cylinder 86. When the cable is properly tensioned by tightening of adjustment means 108, the bight of cable 107 extending around hook 110 is preferably clamped, as by means of clamping members 112.

Cable 107 extends around pulley 111 reversing direction and then extend rearwardly to pulley 113 which is journaled for rotation in a stationary bracket 114 fixed to the rearward-most end of outer boom segment 23 (FIGS. 11 and 12). Cable 107 extends around pulley 113 again reversing direction and extends forwardly to pulley 115 journaled for rotation about a vertical axis on the top side of hose reel carriage frame 96 (FIGS. 13, 14 and 16). Cable 107 extends around pulley 115 again reversing direction and extends rearwardly to the end of outer boom segment 23 where it is anchored at 116 in bracket 114 (FIGS. 11 and 12). It will be seen that, as inner boom segment 24 is extended, tension on hoses 95 is transmitted to the hose reel carriage to move it forwardly. As the inner boom segment is retracted, tension on cable 107 (anchored at one end to the inner boom segment and the other end to the outer boom segment) is transmitted around fixed pulleys 111 and 113 to pulley 115 on the hose reel carriage to cause that carriage to be retracted maintaining tension on the hoses 95.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A mobile extended reach high-lift loader comprising:

(A) a vehicle having a longitudinally extending frame, (B) a first pair of parallel spaced apart horizontal longitudinal track rails supported by the rearward portion of said frame, (C) a second pair of parallel spaced apart horizontal longitudinal track rails supported by said frame forwardly of and lower than said first pair of tracks, (D) a transfer carriage mounted for longitudinal reciprocal movement on said track rails, (E) means for reciprocating said transfer carriage, (F) boom means pivotally secured at one end to said transfer carriage, (G) means for elevating said boom means, and (H) load handling means pivotally secured to the free end of said boom.

2. A loader according to claim 1 further characterized in that said second pair of track rails is spaced inwardly relative to said first pair of track rails.

3. A loader according to claim 1 further characterized in that said transfer carriage includes:

(A) a first pair of roller means on the sides of the carriage adjacent the rearward end thereof, said roller means in engagement with the bottom surface of said first pair of track rails, and (B) a further pair of roller means on the opposite sides of the carriage adjacent the forward end thereof, said further roller means in engagement with the top surface of said second pair of track rails.

4. A loader according to claim 1 further characterized in that:

(A) said boom comprises a plurality of hollow telescoping segments, the outermost of said segments being pivotally secured to the rearward end of said transfer carriage, (B) fluid pressure actuating means are provided at the free end of the innermost segment of said boom for pivoting said load handling means, (C) fluid conduit means extend through said hollow boom segments from a source of fluid under pressure in said vehicle to said fluid pressure actuating means, at least a portion of said fluid conduit means being flexible hose fixedly secured at one end to the innermost of said telescoping boom members and at the other end to the outermost of said telescoping boom segments, (D) a hose reel carriage freely and longitudinally movable within the outermost of said telescoping boom segments, and (E) rotatable hose engaging means on said carriage engaging said hose for movement relative thereto.

5. A loader according to claim 4 further characterized in that:

(A) said hose reel carriage includes a rotatable means for engaging a flexible linear motion transmission element, (B) one end of said linear motion transmission element is secured in a first anchorage at the rearward end of said outermost telescoping boom segment, (C) the other end of said linear motion transmission element is secured in a further anchorage at the rearward end of the next innermost boom segment, (D) said linear motion transmission element extends from said further anchorage:

(1) around a stationary rotatable means mounted at the forward end of the outermost boom segment, (2) to and around a stationary rotatable means mounted at the rearward end of said outermost boom segment, (3) to and around the rotatable means on said hose reel carriage, and (4) to said first anchorage.

6. A loader according to claim 5 further characterized in that said linear motion transmission element is a cable.

7. A loader according to claim 5 further characterized in that one of said anchorages includes a threaded longitudinally adjustable tensioning means.

8. A loader according to claim 4 further characterized in that:

(A) said means for extending the boom includes an elongated hydraulic cylinder mounted within the outermost boom segment, and (B) said hose reel carriage includes:

(1) a frame extending around said cylinder, (2) wheel means on said frame and engaging the inside wall of the outermost boom segment, (3) pulley means rotatable with said wheels and engaged by said hose, and (4) roller means on said frame engaging said cylinder for movement therealong.

9. A mobile high-lift loader according to claim 1 further characterized in that:

(A) said boom comprises a plurality of hollow telescoping segments of rectangular cross section, the outermost segment of said boom being pivotally secured at its rearward end to said transfer carriage, (B) first roller means are carried by the outermost of said boom segments at the bottom of the forward end thereof, the perimeter of said roller means extending within said boom segment, (C) first longitudinal track means are carried on the outside bottom surface of the next innermost boom segment, said first track means engaging said first roller means, (D) further roller means are carried by said next innermost boom segment at the top of the rearward end thereof, the perimeter of said roller means extending outside of said boom segment, and (E) further longitudinal track means are carried on the inside top surface of the outermost boom segment, said further track means engaging said further roller means.

10. A mobile high lift loader according to claim 1 further characterized in that:

(A) said boom comprises a plurality of elongated hollow telescoping segments of rectangular cross section, each of said segments comprising:

(1) a pair of face-to-face abutting open channel members, (2) a plurality of longitudinally spaced apart recesses in the free edges of the opposite side walls of said channel members, and (3) means between said recesses rigidly securing said channel members together, and (B) the outermost segment of the boom is pivotally secured at its rearward end to said transfer carriage.

11. A mobile high-lift loader comprising:

(A) a vehicle having a longitudinally extending frame, (B) an elongated telescopic boom comprised of a plurality of hollow segments, the outermost segment of said boom being pivotally secured at one end to said vehicle, (C) means for elevating said boom, (D) means within said boom segments for extending and retracting said boom, said means including an elongated hydraulic cylinder mounted within the outermost boom segment, (E) load handling means pivotally secured to the free end of the innermost segment of said boom, (F) fluid pressure actuating means at the free end of said boom for pivoting said load handling means, (G) fluid conduit means extending through said hollow boom segments from a source of fluid under pressure in said vehicle to said fluid pressure actuating means, at least a portion of said fluid conduit means being flexible hose fixedly secured at one end to the innermost of said telescoping boom segments and at the other end to the outermost of said telescoping boom segments, and (H) a hose reel carriage freely and longitudinally movable within the outermost of said telescoping boom segments, said hose reel carriage including:

(1) a frame extending around said cylinder, (2) wheel means on said frame and engaging the inside wall of the outermost boom segment, (3) pulley means on said carriage rotatable with said wheels and engaged by said hose for movement relative thereto, and (4) roller means on said frame engaging said cylinder for movement therealong.

12. A loader according to claim 11 further characterized in that:

(A) said boom segments are of rectangular cross section, (B) first roller means are carried by the outermost of said boom segments at the bottom of the forward end thereof, the perimeter of said roller means extending within said boom segment, (C) first longitudinal track means are carried on the outside bottom surface of the next innermost boom segment, said first track means engaging said first roller means, (D) further roller means are carried by said next innermost boom segment at the top of the rearward end thereof, the perimeter of said roller means extending outside of said boom segment, and (E) further longitudinal track means are carried on the inside top surface of the outermost boom segment, said further track means engaging said further roller means.

13. A loader according to claim 12 further characterized in that:

(A) said roller means each comprise a pair of spaced apart flanged wheels, and (B) said track means comprise elongated spaced apart parallel replaceable wear plates.

14. A mobile high-lift loader comprising:

(A) a vehicle having a longitudinally extending frame, said vehicle including:

(1) a first pair of parallel spaced apart horizontal longitudinal track rails supported by the rearward portion of said frame, (2) a second pair of parallel spaced apart horizontal longitudinal track rails supported by said frame forwardly of and lower than said first pair of track rails, said second pair of track rails being spaced inwardly relative to said first pair of track rails, (3) a transfer carriage mounted for longitudinal reciprocal movement on said track rails, and (4) means for reciprocating said transfer carriage, (B) an elongated telescopic boom comprised of a plurality of hollow segments, said boom being pivotally secured at one end to said vehicle through said carriage, the outermost boom segment being pivotally connected to the rearward end of said transfer carriage, (C) means for elevating said boom, (D) means within said boom segments for extending and retracting said boom, (E) load handling means pivotally secured to the free end of the innermost segment of said boom, (F) fluid pressure actuating means at the free end of said boom for pivoting said load handling means, (G) fluid conduit means extending through said hollow boom segments from a source of fluid under pressure in said vehicle to said fluid pressure actuating means, at least a portion of said fluid conduit means being flexible hose fixedly secured at one end to the innermost of said telescoping boom segments and at the other end to the outermost of said telescoping boom segments, (H) a hose reel carriage freely and longitudinally movable within the outermost of said telescoping boom segments, and (I) rotatable hose engaging means on said carriage engaging said hose for movement relative thereto.

* * * * *